US008113872B2

(12) United States Patent
Takahashi et al.

(10) Patent No.: US 8,113,872 B2
(45) Date of Patent: Feb. 14, 2012

(54) FLAT-CABLE CONNECTOR, PRODUCTION PROCESS THEREOF, AND LOCKING DEVICE

(75) Inventors: Koki Takahashi, Shinagawa (JP); Manabu Shimizu, Shinagawa (JP); Kazuya Orui, Kawasaki (JP)

(73) Assignees: Fujitsu Component Limited, Tokyo (JP); Fujitsu Limited, Kawasaki (JP)

( * ) Notice: Subject to any disclaimer, the term of this patent is extended or adjusted under 35 U.S.C. 154(b) by 0 days.

(21) Appl. No.: 12/974,905

(22) Filed: Dec. 21, 2010

(65) Prior Publication Data

US 2011/0159719 A1 Jun. 30, 2011

(30) Foreign Application Priority Data

Dec. 24, 2009 (JP) ..... 2009-292891

(51) Int. Cl.
*H01R 13/54* (2006.01)

(52) U.S. Cl. ..... 439/495

(58) Field of Classification Search ..... 439/495, 439/496

See application file for complete search history.

(56) References Cited

U.S. PATENT DOCUMENTS 3,289,146 A * 11/1966 Tuchel ..... 439/743
3,829,817 A * 8/1974 Beavitt ..... 439/59
6,394,833 B1 * 5/2002 Bulmer et al. ..... 439/393

FOREIGN PATENT DOCUMENTS

JP 8-250232 9/1996
JP 11-54220 2/1999

* cited by examiner

*Primary Examiner* — Gary F. Paumen
(74) *Attorney, Agent, or Firm* — Staas & Halsey LLP

(57) ABSTRACT

A flat cable connector includes an insulated housing, a plurality of conductor contacts regularly arranged in the housing at a predetermined interval pads of a flat cable are connected with the contacts, respectively, when the flat cable is inserted into the housing. The conductor contact includes a stationary portion secured to the housing and a movable portion integrally formed with the stationary portion being resiliently moved with respect to the stationary portion, the conductive pads of the flat cable come into contact therewith.

2 Claims, 6 Drawing Sheets

FIG.3B
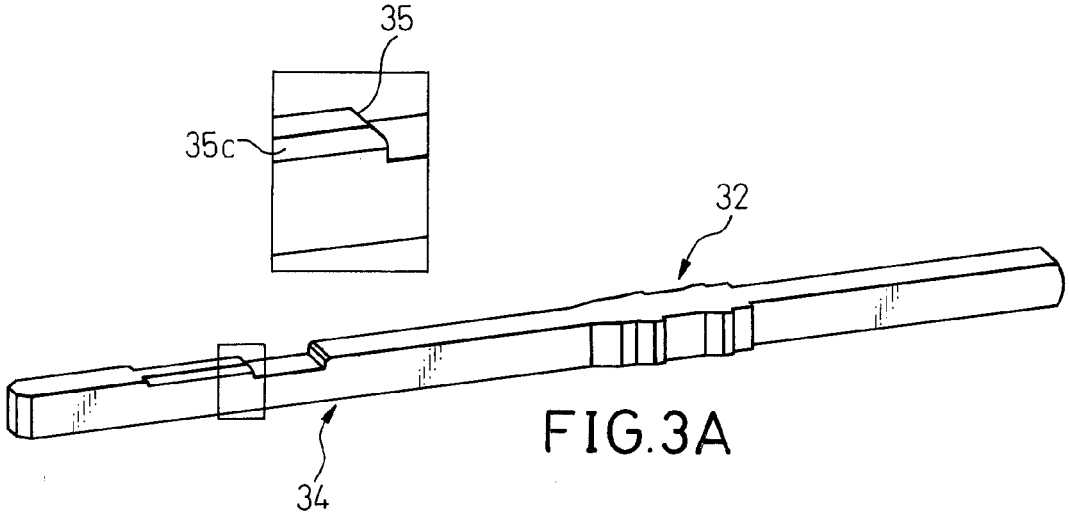
FIG.3A
FIG.4B
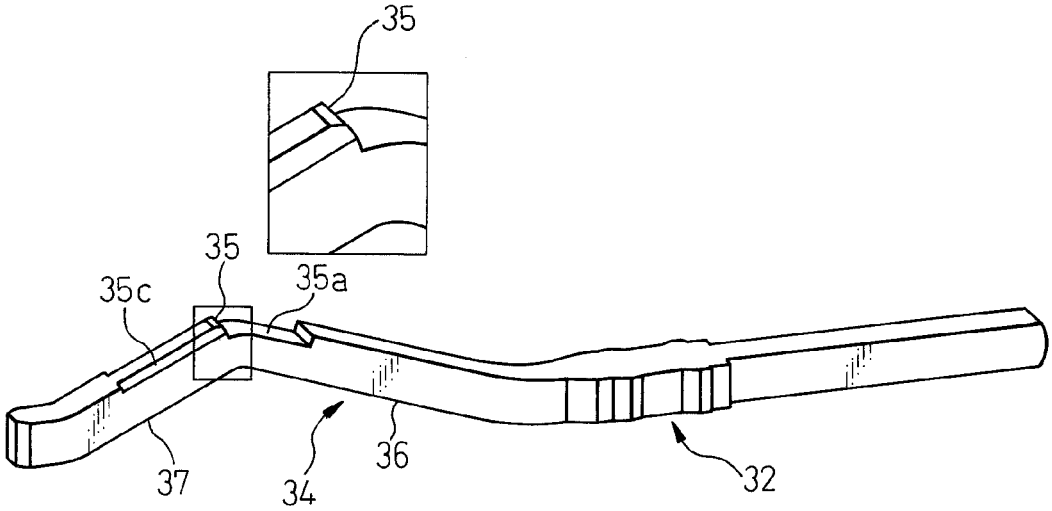
FIG.4A

FIG.5B
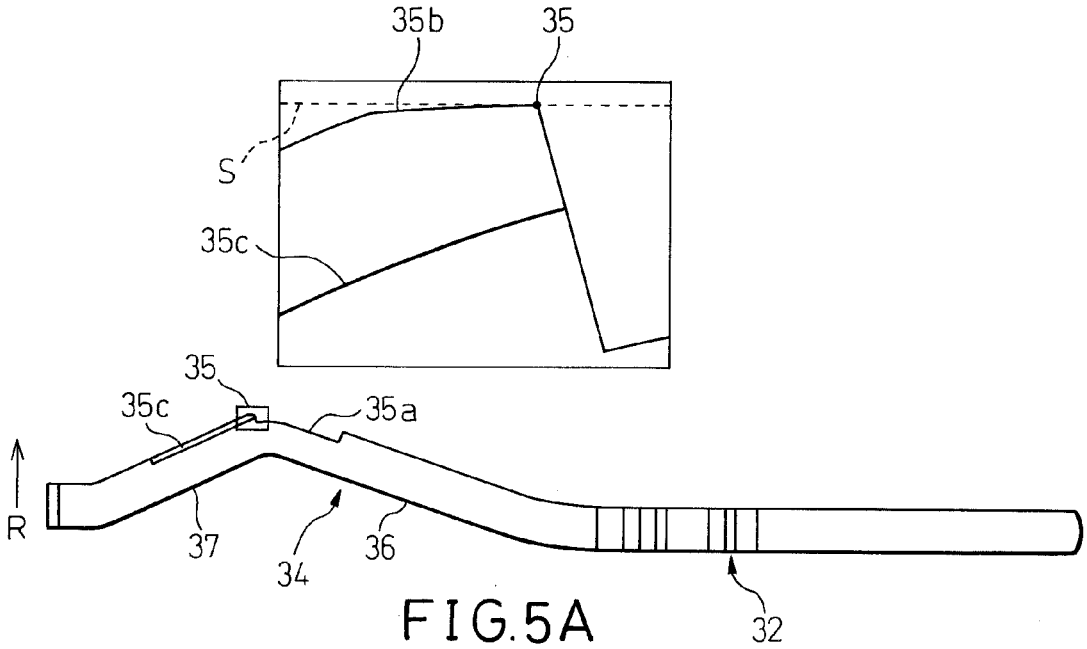
FIG.5A
FIG.6
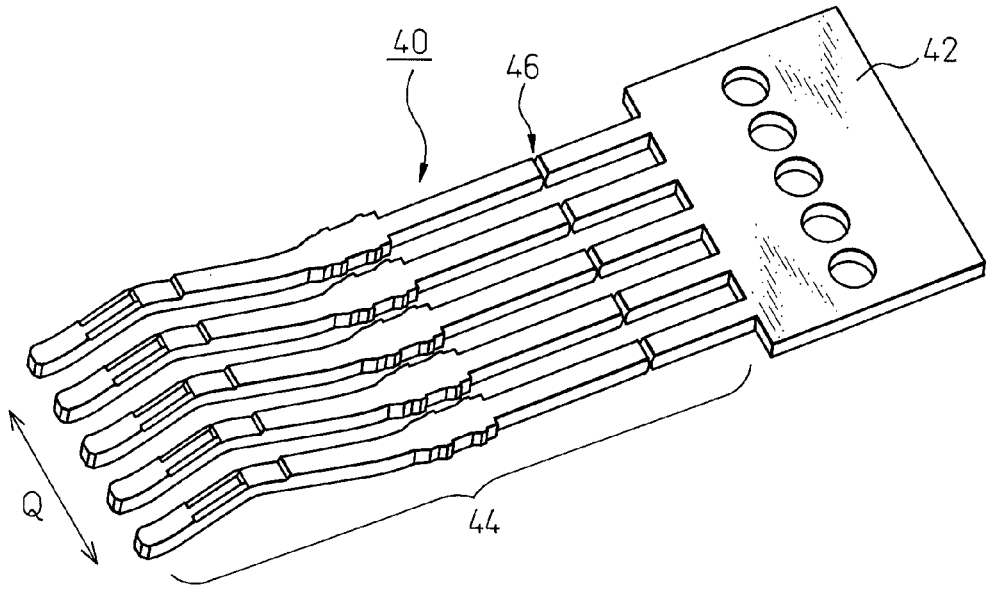

FLAT-CABLE CONNECTOR, PRODUCTION PROCESS THEREOF, AND LOCKING DEVICE

CROSS-REFERENCE TO RELATED APPLICATION

This application is based upon and claims the benefit of priority of the prior Japanese Patent Application No. 2009-292891, filed on Dec. 24, 2009, the entire contents of which are incorporated herein by reference.

FIELD

Embodiments discussed herein are related to a flat-cable connector, a production process of the flat-cable connector, and a locking device.

BACKGROUND

Conventionally, a flat-cable connector to be connected to a flat cable such as a flexible printed circuit (FPC), a flexible flat cable (FFC), or the like has a structure where a large number of conductor contacts are inserted at a predetermined interval into an insulated housing which has been formed by molding a resin, and arranged and secured. The large number conductor contacts are produced at once by punching a metal plate operating a spring action, for example, a copper plate, etc., by press working. In this case, the surface punched by press working (namely, a fracture surface) defines a contact point of the contact to enlarge friction at the contact portion, and prevent fretting corrosion.

However, when the metal plate is formed into a teeth-like shape of a comb, and a predetermined number of contacts are inserted in the insulated housing at once, the pitch of the contacts must be larger than the height of the contacts. Accordingly, in a narrow-pitch connector wherein the fracture surface defines a contact point of the contact, normally, it is not possible to insert a predetermined number of contacts into the insulated housing at once, and the conductor contact must be inserted into the insulated housing one by one.

Further, when the conventional flat cable is inserted in the connector, a plurality of conductive pads of the inserted flat cable must be maintained in the condition that the pads are respectively brought into contact with the respective conductor contacts at the connector side. However, there has been no mechanism for securing the flat cable at the insertion position in the connector with a simple configuration so as not to generate fine sliding. Therefore, there is a problem of abrasion between the contact points caused by the fine sliding between the respective conductive pads of the flat cable and the respective conductor contacts of the connector.

A conductor contact disclosed in JP-A-8-250232 has an insulated housing, a plurality of conductive terminals, and an actuator. The actuator is rotatable between a plane substantially perpendicular to the surface where the contacts are juxtaposed and a plane parallel to the juxtaposed surface. The flat cable is inserted in the actuator under the condition that the actuator is standing so as to be located in the substantially perpendicular plane, and thereafter, the actuator is laid so as to be located in the parallel plane. Thereby, the pressing surface of the actuator presses the contacts to the side of the conductive terminal for securing.

A flexible circuit board connector disclosed in JP-A-11-54220 has an insulated housing where two contacts are staggeredly arranged for one pin, and a pressurizing member which can be open or closed with respect to the housing is provided. When the pressurizing member is open, posts located at the opposite end surfaces thereof engage with elastic engagement pieces to prevent removal from the insulated housing. Then, the pressurizing member is closed, while the engagement between the posts and the elastic engagement pieces is released, a locking projection of the pressurizing member engages with the insulated housing to provide a sufficient contact pressure to the flexible circuit board and the contact.

In JP-A-8-250232 and JP-A-11-54220, a mechanism which maintains a condition that a plurality of conductive pads of the inserted flat cable are respectively brought into contact with the respective conductor contacts at the connector side, after the flat cable such as FPC, FFC, or the like, is inserted into the connector. However, in the conventional flat-cable connector disclosed in these documents, an actuator and a pressurizing member must be provided to be rotatable with respect to the insulated housing, and thus, a space for rotating these members is required. Further, there is a problem that because the actuator and the pressurizing member are operated, the structure becomes complicated.

Also, the conventional flat-cable connector has a structure that the flat cable and the contact are pressed, and thus, when an external force or vibration is applied, fine vibration or fine sliding may be caused between the flat cable and the contact. Thus, there is a problem that the fretting corrosion between the cable and the contact cannot be sufficiently prevented or decreased.

SUMMARY

According to an embodiment of the present invention, a flat cable connector includes: an insulated housing; a plurality of conductor contacts regularly arranged in the insulated housing in which a plurality of conductive pads of a flat cable are in contact with the plurality of contacts, respectively, when the flat cable is inserted into the insulated housing. Each of the conductor contacts includes a stationary portion secured to the insulated housing and a movable portion integrally formed with the stationary portion. The movable portion is resiliently moved with respect to the stationary portion. An edge which is formed at an apex of the movable portion is defined as a contact point with the conductive pads of the flat cable when the conductive pads of the flat cable come into contact with the conductor contacts.

It is to be understood that both the foregoing general description and the following detailed description are exemplary and explanatory, and are not restrictive of the invention.

BRIEF DESCRIPTION OF THE DRAWINGS

FIGS. 3A and 3B are perspective views of a contact before a bending process;

FIGS. 4A and 4B are perspective views of a contact after a bending process;

FIG. 5A is a side view of a contact after a bending process, and FIG. 5B is a partial enlarged view of FIG. 5A;

FIG. 6 is a perspective view of a contact with a carrier;

DESCRIPTION OF EMBODIMENTS

Hereinafter, a flat-cable connector, a production process of the flat-cable connector, and a locking device according to the embodiments of the present invention will be described with reference to the attached drawings.

Figure 1:
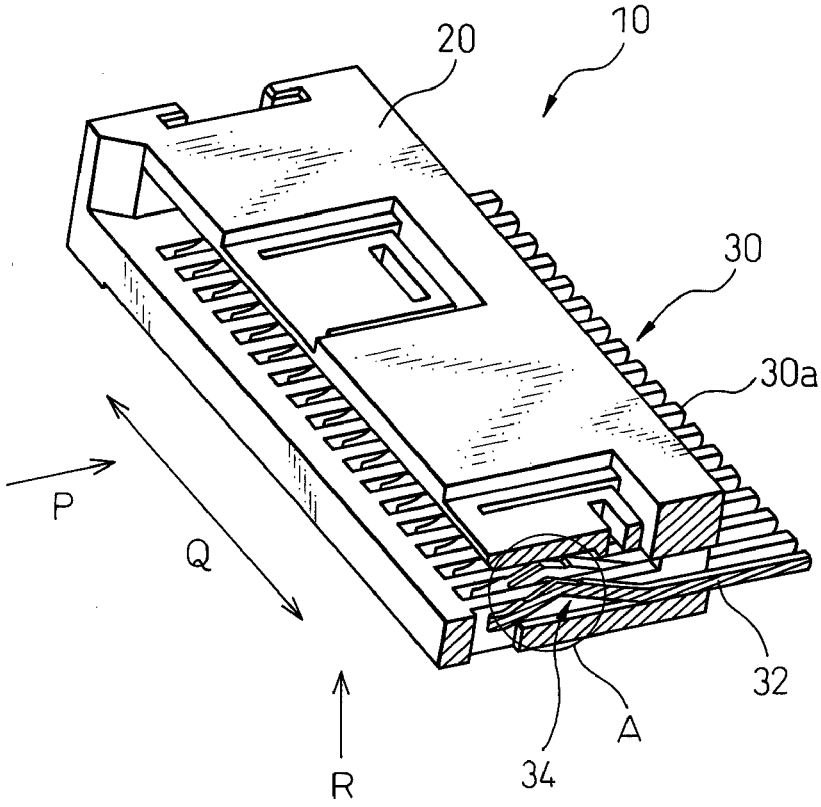
FIG. 1 is a perspective view of the flat-cable connector.
Figure 2:
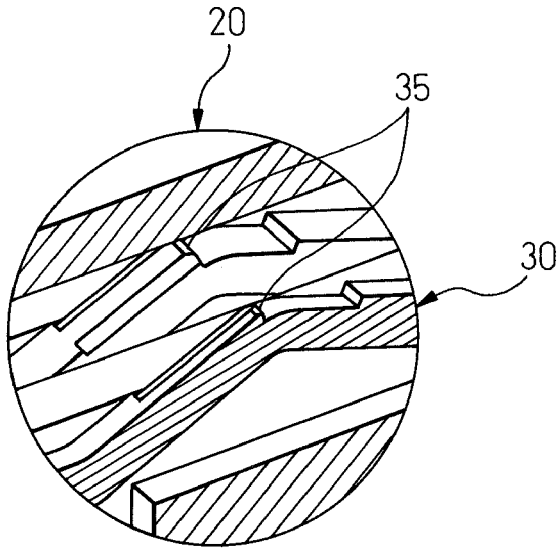
FIG. 2 is an enlarged detailed view illustrating the portion A of FIG. 1.

FIG. 1 is a perspective view of the flat-cable connector according to an embodiment of the present invention, a part of which is broken so that the inside can be viewed. FIG. 2 is a detail view of the broken portion A of FIG. 1.

The flat-cable connector 10 according to the embodiment of the present invention includes a housing 20 made of an insulation material such as a resin, etc., and a plurality of (for example, approximately 20 to 100 in one row) conductor contacts 30 which are juxtaposed at a predetermined interval in the housing 20 in the direction Q which is perpendicular to the insertion direction P of the flat cable which is not shown in FIG. 1. For example, the arrangement pitch of the conductor contacts 30 is approximately 1.0 mm, and the width of the conductor contact 30 as such is approximately 0.4 mm.

Each conductor contact 30 is configured by integrating by a stationary portion 32 secured in the insulated housing 20, with a movable portion 34 which can be bent with respect to the stationary portion 32 when the flat cable is inserted into the insulated housing 20 and the conductive pad (not shown) of the cable side is brought into contact with the movable portion. Accordingly, in the state that the flat cable is not inserted in the insulated housing 20, as shown in FIG. 1, the movable portion is not in contact with, or bound to the portion of the insulated housing 10, and can be bent within a predetermined range.

As shown in FIG. 2 and FIG. 3A to FIG. 5A, before the bending process by pressing, each conductor contact 30 substantially linearly extends from the stationary portion 32 to the movable portion 34 (FIG. 3). However, after the bending process, only the stationary portion 32 has the substantially linear shape, and the movable portion 34 is formed into a substantially V shape by a first portion 36 which is bent in a predetermined direction with respect to stationary portion 32, namely, bent to one side (for example, upper side) in the direction R which is perpendicular to the insertion direction P of the flat cable and the arrangement direction Q of the conductor contact 30, and a second portion 37 which is bent to the side opposite to the direction R (for example, lower side). Then, an edge portion 35 is formed at the top of the substantially V shape.

Here, the edge portion 35 is a portion which functions as a contact point with the conductive pad at the cable side, between a period from the time point that the flat cable is inserted in the insulated housing 20 to initiate contact at the conductive pad (not shown) of the cable side, and the movable portion 34 starts to be bent, and until the insertion of the flat cable is complete and the movable portion 34 is bent by a predetermined amount with respect to the stationary portion 32.

Namely, as shown in detail in FIG. 3B to FIG. 5B, the front side, i.e., the side of the first portion 36, of the edge portion 35 at the top of the substantially V-shaped movable portion 34 is provided with a notch 35*a* on the upper surface thereof, whereas the back side, i.e., the side of the second portion 37 of the edge portion 35 is provided with a portion 35*b* the upper surface of which has a moderate inclination angle. Further, at the side of the second portion 37, the upper surface is removed for a predetermined range on the opposite sides to define a portion 35*c* having a narrower upper surface.

With this structure, as shown in FIG. 5B, with respect to the conductor contact 30, during a stroke of a contact point from the start of contact of the conductive pad (contact surface is represented by S) when the flat cable is inserted until the completion of the insertion, only the edge portion 35 having a comparatively small area of the conductor contact 30 is always brought into steady contact with the contact surface S of the conductive pad of the flat cable. Therefore, fine sliding friction at the contact portion can be effectively prevented.

Next, with reference to FIG. 6 and FIG. 7, a production process a flat-cable connector according to an embodiment of the present invention will be explained. FIG. 6 is a perspective view of a contact with a carrier.

First, a contact material having a spring properaty, for example, a metal plate (not shown) of phosphor bronze, beryllium copper, titanium copper, etc., is press-worked, etc., to thereby form a contact with carrier 40 wherein a plurality of contacts are respectively connected to the carrier portion to form a comb-teeth shape as shown in FIG. 6. Here, the carrier portion 42 of the contact with carrier 40 holds a plurality of (for example, approximately 3 to 100 in one row) contact portions 44 necessary for one predetermined flat-cable connector 10 so that the contact portions are juxtaposed at a predetermined interval.

Then, when the metal plate (not shown) is press-worked to form a comb-teeth shaped contact with carrier 40, the contact with carriers 40 are subjected to bending processes by a plurality of pressing steps. Thereby, as mentioned above, in the individual conductor contact 30 held by the carrier portion 42, a stationary portion 32 which is pressure bonded to the insulated housing 20 on the surface perpendicular to the contact arrangement direction Q, and a movable portion 34 which can be bent with respect to the stationary portion 32 when brought into contact with the conductive pad (not shown) of the flat cable are integrally formed, and the edge portion 35 is formed at the top of the movable portion 34. Likewise, at the time of forming the comb-teeth shaped contact with carrier 40 by press working the metal plate by a plurality of steps, a notched portion 46 defined by a V-shaped or a concave shaped groove is formed on both surfaces or one surface of the respective contact 30 at position closer to the carrier portion 42.

In the next step, the contact with carrier 40 is press fitted in the insulated housing 20 as a lump. In this case, the press-fitting to the insulated housing 20 is performed from the back side of the insulated housing 20 in the direction opposite to the insertion direction P of the flat cable (not shown) into the housing.

Figure 7:
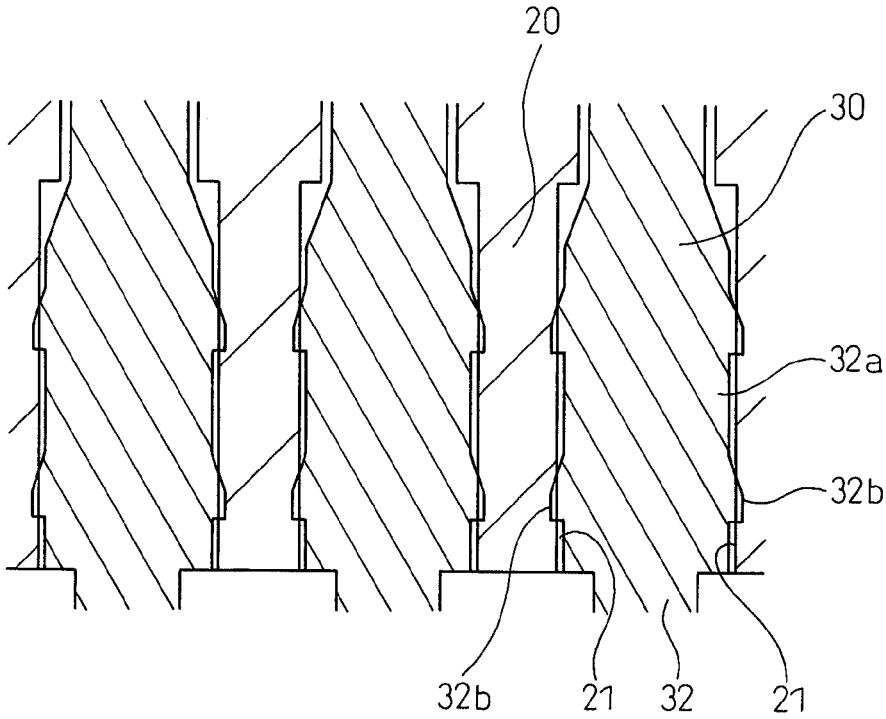
FIG. 7 is a cross-sectional view of a press-fit portion of a contact.

As shown in FIG. 6 and FIG. 7, the stationary portion 32 of the individual conductor contact 30 has a portion 32*a* where the width is expanded to the opposite sides and where an angled projections 32*b* are provided. In contrast, a portion 21 having a slightly larger groove width is provided at a portion of the insulated housing 20 which defines a lower side of a passage through which the individual conductor contact 30 is press fitted, and which corresponds to the stationary portion 32 of the conductor contact 30. When the contact with carrier 40 is press fitted as a lump into the insulated housing 20, while all of the conductor contacts 30 are pressed to the downward, the wide width portions 32*a* of the respective conductor contacts 30 are fitted into the groove portions 21 all at once, and at the same time, the projections 32*b* bite into the walls of the groove portions 21 for securing.

Accordingly, after the contact with carrier 40 is press fitted and secured in the insulated housing 20, the carrier portion 42 located at the rearward of the insulated housing 20 is cut off at the notched portion 46. Thereby, electrical continuity between the respective conductor contacts 30 is discontinued. Then, the flat-cable connector 10 is deemed as being complete. In accordance with need, necessary treatments may be performed to the respective terminal portions 30*a* (FIG. 1) extending to the backward of the insulated housing 20 in order to mount the connector 10 onto a desired printed circuit substrate (not shown). For example, for the surface mounting (SMT) on a conductive pad (not shown) provided on the printed circuit board to correspond to the contact 30, a bending process to make the tip end of terminal portion 30*a* correspond to the printed circuit substrate surface, a folding process to fold the terminal portion 30*a* to the back side of the insulated housing 20, etc., are applied.

Figure 8:
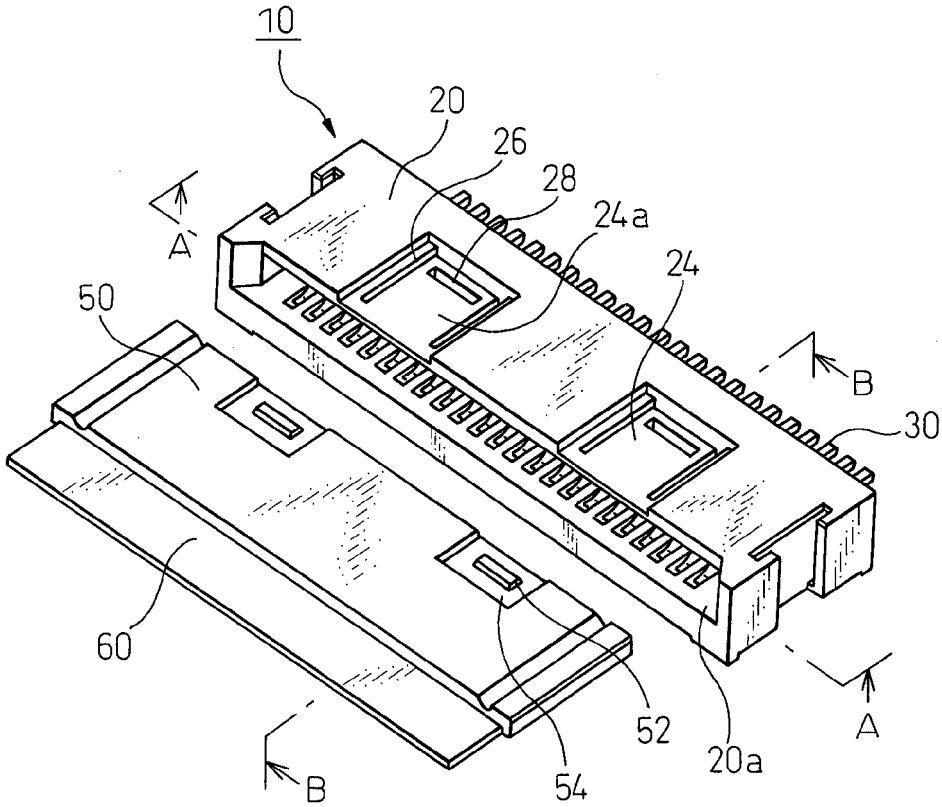
FIG. 8 is a perspective view showing the state before the cable is locked in the flat-cable connector.
Figure 9:
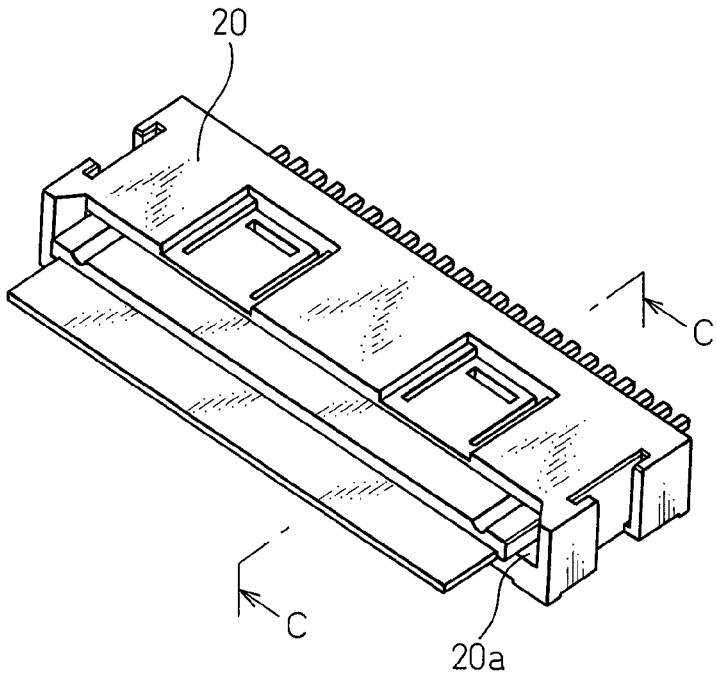
FIG. 9 is a perspective view showing the state after the cable is locked in the flat-cable connector.
Figure 10A:
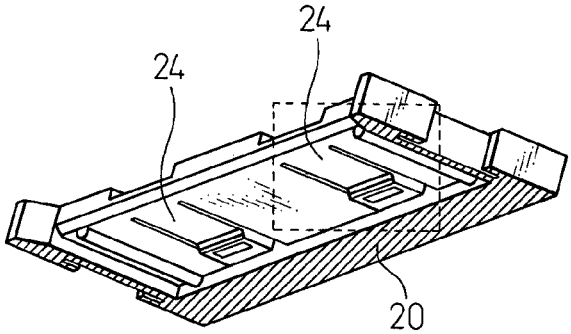
FIG. 10A is a cross-sectional view taken along A-A line of FIG. 8.
Figure 10B:
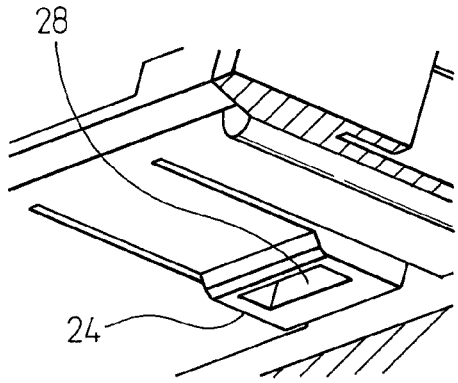
FIG. 10B is a partial enlarged view of FIG. 10A.
Figure 11:
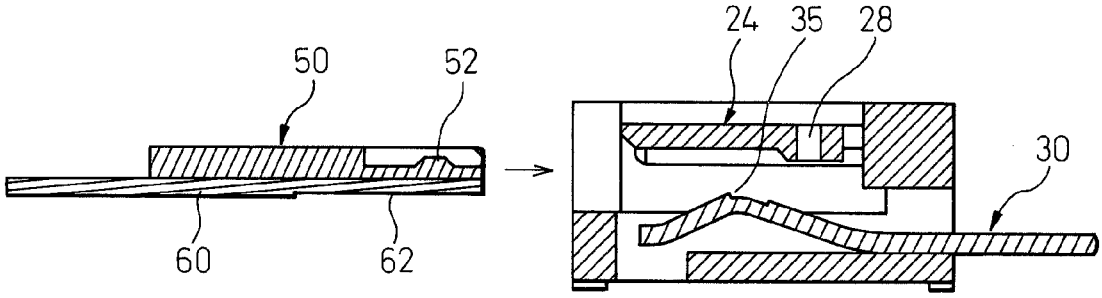
FIG. 11 is a cross-sectional view taken along B-B line of FIG. 8.
Figure 12B:
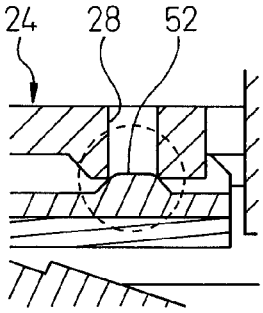
FIG. 12B is a partial enlarged view of FIG. 12A.
Figure 12A:
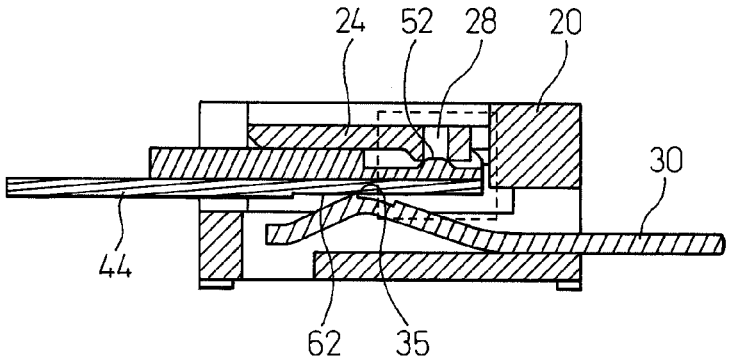
FIG. 12A is a cross-sectional view taken along C-C line of FIG. 9

Next, a locking mechanism of the flat-cable connector according to an embodiment of the present invention will be explained. FIG. 8 is a perspective view showing the state before the flat cable is locked to the connector. FIG. 9 is a perspective view showing the state after the flat cable is locked to the connector. FIG. 10A is a perspective view showing a cross section taken along A-A line of FIG. 8, and FIG. 10B is a partly enlarged view thereof. FIG. 11 is a cross sectional view taken along B-B line of FIG. 8. FIG. 12A is a cross sectional view taken along C-C line of FIG. 9, and FIG. 12B is a partial enlarged view thereof.

The connector 10 has the similar structure as the aforementioned structure shown in FIG. 1 to FIG. 7, and thus, redundant explanations may be omitted. Hereinafter, the explanation regarding is the structure and operation of the flat cable having a guide member and the locking mechanism is mainly described.

The flat cable 60 is formed by a flexible flat cable (FFC), a flexible printed circuit substrate (FPC), or the like (in the present specification, generally referred to as "flat cable"). The flat cable 60 provided, for example, at its tip portion, and on one or both surfaces (here, only the rear surface), with a plurality of conductive pads (not shown) which are arranged corresponding to the arrangement of the contacts 30. At the tip portion of the flat cable 60 and on the surface (here, the upper surface) opposite to the surface provided with the conductive pads 62, a guide member 50 formed by a resin, etc., is attached by an adhesive agent, etc., and integrated with the flat cable 60.

On the upper surface of the guide member 50, two convex portions 52 are arranged in the width direction at a predetermined interval. The two convex portions 52 are respectively formed in flat recesses 54. The guide member 50 has a shape which can be inserted from a cable insertion opening 20*a* of the insulated housing 20 of the connector 10. The convex portion 52 has a substantially trapezoidal cross section.

On the other hand, the insulated housing 20 of the connector 10 is provided with two molded springs 24 having openings (or concave portions) which engage with the convex portions 52 of the guide member when connection between the flat cable 60 and the connector 10 is complete. The molded springs 24 are made of two thin portions 24*a* formed on the upper wall of the insulated housing 20, and substantially U-shaped slits 26 are formed along the periphery of the thin portions 24*a*. The portion within the substantially U-shaped slit 26 defines the molded spring 24. Then, a free end side of the molded spring 24 has a slightly thick portion extending from its lower side, and an opening 28 is formed at this portion. As mentioned above, the insulated housing 20 is produced by injection molding, etc., of a resin. Because the substantially U-shaped slit 26 is provided, the portion surrounded by the slit 26, i.e., a portion of the resin molded body, can be elastically bent with respect to the other portions of the insulated housing 20. In the present specification, this portion is referred to as a molded spring 24.

Therefore, when the flat cable 60 is inserted into the insertion opening 20*a* of the insulated housing of the connector 10, from the time point when each conductive pad 62 of the flat cable 60 is brought into contact with the edge portion 35 of the contact 30, the substantially V-shaped movable portion 34 of the contact 30 starts to be bent by a predetermined amount. At the time point when the insertion of the flat cable 60 into the connector 10 is complete, the convex portions 52 of the guide member 50 are fitted into the respective openings 28 of the molded springs 24 of the connector 10 so as to maintain the electrical connection between each conductive pad of the flat cable 60 and each contact 30 of the connector 10, and to lock the flat cable 60 to the connector 10.

In particular, because the cross section of the convex portion 52 is substantially trapezoidal, once the flat cable 60 is locked to the connector 10, even if some sort of external force is applied or vibration is transmitted to the flat cable 60, the connector 10, or the like, the connection between the flat cable 60 and the connector 10 would not receive influence from the external force, vibration, etc. Therefore, the sliding abrasion between the edge portion 35 of each contact 30 and the conductive pad of the flat cable 60 can be avoided, or can be extremely reduced.

Upon removing the flat cable 60 from the connector 10, when the guide member 50 is pulled out from the insulated housing 20 of the connector 10, the engagement between the convex portion 52 of the guide member 50 and the opening 28 of the molded spring 24 is disengaged, and the connection between each conductive pad of the flat cable 60 and each contact 30 of the connector 10 is released, and then, the flat cable 60 can be removed from the connector 10.

In the above explanation, the guide member 50 is provided with the convex portion 52, and the molded spring 24 in the insulated housing 20 of the connector 10 is provided with the opening (or concave portion) 28. However, on the contrary, it is possible to form a concave portion or opening on the guide member 50, and the convex portion on the molded spring 24. In either case, the engaging portion and the to-be-engaged portion are constituted so that when the insertion and connection are complete, they are fitted with each other and locked, and upon removing, they are disengaged and unlocked.

An embodiment of the present invention has been explained above with reference to the attached drawings. However, the present invention is not limited to the above embodiment. Various forms, changes, modifications, etc., are possible within the sprint and the scope of the present invention.

As explained above, the flat-cable connector and its production process, as well as the locking mechanism for the flat-cable connector according to the present invention can be conveniently used for connecting the flat cable to a connector for a flat cable of any types such as FFC of FPC, in particular, a connector secured on the printed wiring substrate. Specifically, only the edge portion of the conductor contact is in contact with the conductive pad of the flat cable, the abrasion caused by the fine sliding therebetween can be prevented. Thus, this can be widely utilized for the connection between the flat cable and the connector on the printed wiring substrate in a fold type mobile phone, information processing device, and the like.

All examples and conditional language recited herein are intended for pedagogical objects to aid the reader in understanding the invention and the concepts contributed by the inventors to further the art, and are to be construed as being without limitation to such specifically recited examples and conditions, nor does the organization of such examples in the specification relate to a showing of the superiority and inferiority of the invention. Although the embodiments of the invention have been described in detail, it will be understood by those of ordinary skill in the relevant art that various changes, substitutions, and alterations could be made hereto without departing from the spirit and scope of the invention as set forth in the claims.

What is claimed is:

1. A flat cable connector comprising:

an insulated housing; and a plurality of conductor contacts regularly arranged in the insulated housing in which a plurality of conductive pads of a flat cable are respectively in contact with the plurality of contacts when the flat cable is inserted into the insulated housing, wherein each of the conductor contacts includes a stationary portion secured to the insulated housing and a movable portion integrally formed with the stationary portion, the movable portion is resiliently moved with respect to the stationary portion, an edge formed at an apex of the movable portion is defined as a contact point with the conductive pads of the flat cable when the conductive pads of the flat cable come into contact with the conductor contacts, and in a plane perpendicular to the direction in which the plurality of conductor contacts are arranged, the stationary portion of the conductor contact is linearly extended and the movable portion defines a substantially V-shape including a first portion extended from the stationary portion and bent to one direction and a second portion bent to an opposite direction from the first portion, and the edge is defined at an apex of the substantially L-shape.

2. A flat cable connector as set forth in claim 1, wherein, lengths, widths and radiuses of the first portion, of the second portion and of the edge of the contact are determined, respectively, so as to obtain a larger contact friction to reduce a micro-slipping friction at an abutting position between the edge and the conductive pad of the flat cable.

* * * * *